US007797778B2

(12) United States Patent
Lee

(10) Patent No.: US 7,797,778 B2
(45) Date of Patent: Sep. 21, 2010

(54) DRUM TYPE WASHING MACHINE AND CONTROLLING METHOD THEREOF

(75) Inventor: Phal Jin Lee, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 1022 days.

(21) Appl. No.: 10/567,852

(22) PCT Filed: May 2, 2005

(86) PCT No.: PCT/KR2005/001268

§ 371 (c)(1),
(2), (4) Date: Feb. 10, 2006

(87) PCT Pub. No.: WO2005/106096

PCT Pub. Date: Nov. 10, 2005

(65) Prior Publication Data

US 2006/0230544 A1 Oct. 19, 2006

(30) Foreign Application Priority Data

May 3, 2004 (KR) ..... 10-2004-0030967

(51) Int. Cl.
*D06F 33/02* (2006.01)

(52) U.S. Cl. ..... 8/159; 68/12.06

(58) Field of Classification Search ..... 134/184, 134/198; 68/12.06; 8/159
See application file for complete search history.

(56) References Cited

U.S. PATENT DOCUMENTS 3,194,398 A * 7/1965 Fecho ..... 34/319
4,411,664 A * 10/1983 Rickard et al. ..... 8/158
5,850,746 A * 12/1998 Lee ..... 68/12.06
5,887,456 A * 3/1999 Tanigawa et al. ..... 68/20
6,029,299 A * 2/2000 Baek et al. ..... 8/159
6,065,170 A * 5/2000 Jang ..... 8/158
6,163,912 A * 12/2000 Matsuura et al. ..... 8/159
6,539,753 B1 * 4/2003 Ito et al. ..... 68/3 R

FOREIGN PATENT DOCUMENTS

DE 3416639 11/1985

(Continued)

OTHER PUBLICATIONS

International Search Report dated Jul. 25, 2005.

*Primary Examiner*—Frankie L Stinson
(74) *Attorney, Agent, or Firm*—McKenna Long & Aldridge LLP

(57) ABSTRACT

A drum type washing machine and controlling method thereof is provided. In the drum type washing machine, a tub is provided, a drum is installed in the tub to rotate about a horizontal axis, a driving motor rotates the drum, a key input unit receives a washing instruction from a user, a memory stores a reference quantity value and a reference eccentricity value, a microcomputer controls washing and rinsing operations in accordance with a procedure set by the user upon an input of a start command through the key input unit and it also controls a preliminary spin drying operation to be selectively performed based on a comparison result obtained by comparing a measured laundry quantity and a measured eccentricity with the reference quantity value and the reference eccentricity value, and a driving control unit controlling the driving motor in accordance with a control signal of the microcomputer.

7 Claims, 4 Drawing Sheets

FOREIGN PATENT DOCUMENTS

| | | | | |
|---|---|---|---|---|
| JP | 04-020387 | | * | 4/1992 |
| JP | 09-276583 | A | | 10/1997 |
| JP | 11-207078 | | * | 8/1999 |
| JP | 2000-051579 | A | | 2/2000 |
| JP | 2001-300186 | A | | 2/2000 |
| JP | 2001-029682 | A | | 2/2001 |
| JP | 2002-136792 | A | | 5/2002 |
| WO | WO 03/046271 | | | 6/2003 |

* cited by examiner

[Fig. 1]
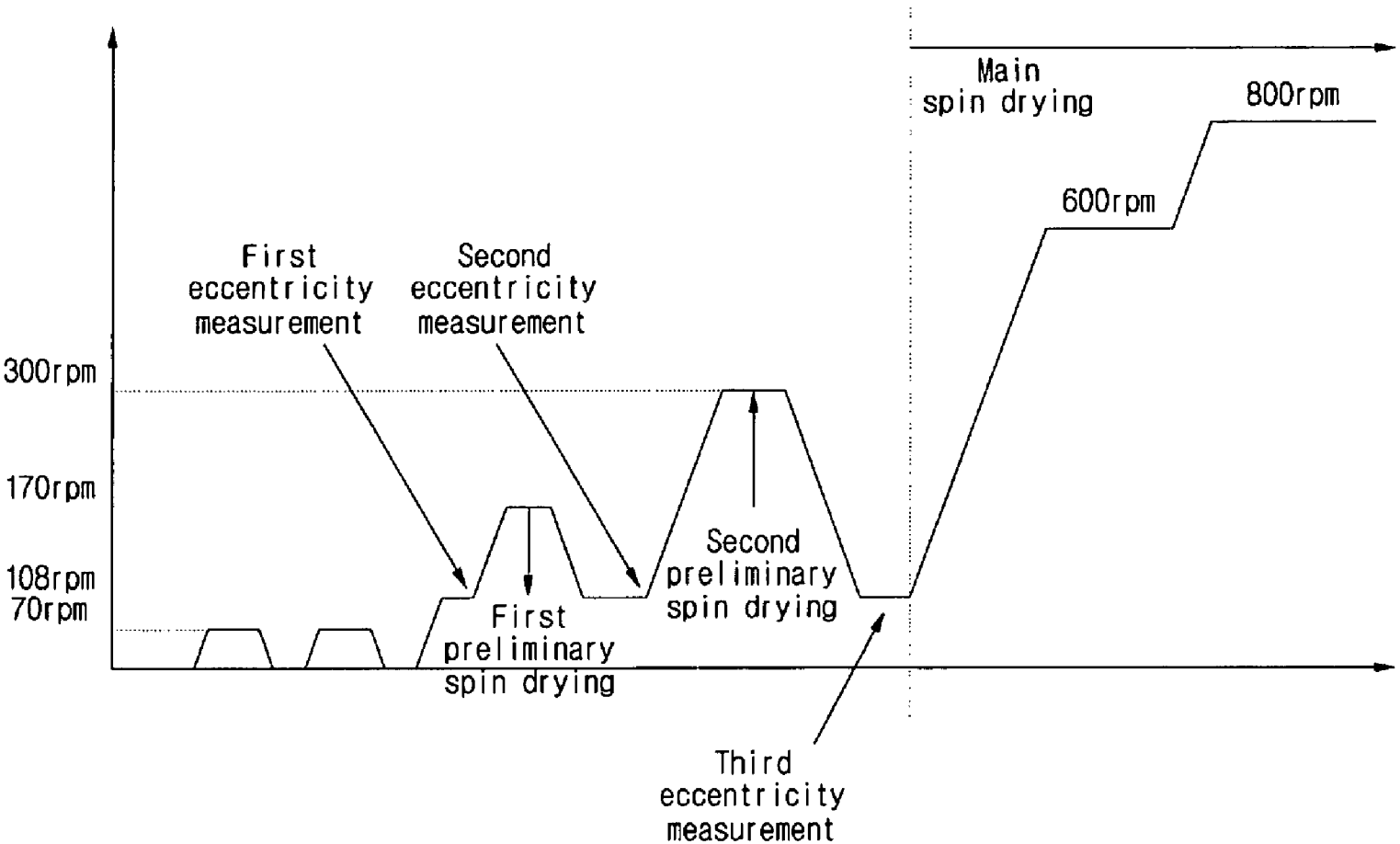

[Fig. 2]
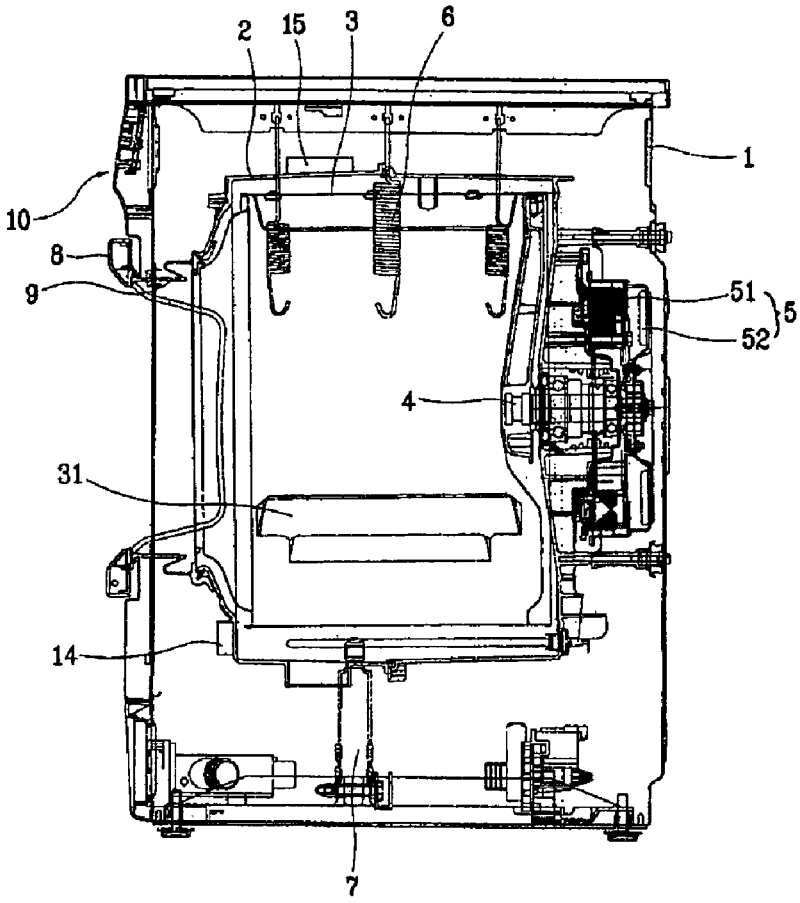
[Fig. 3]
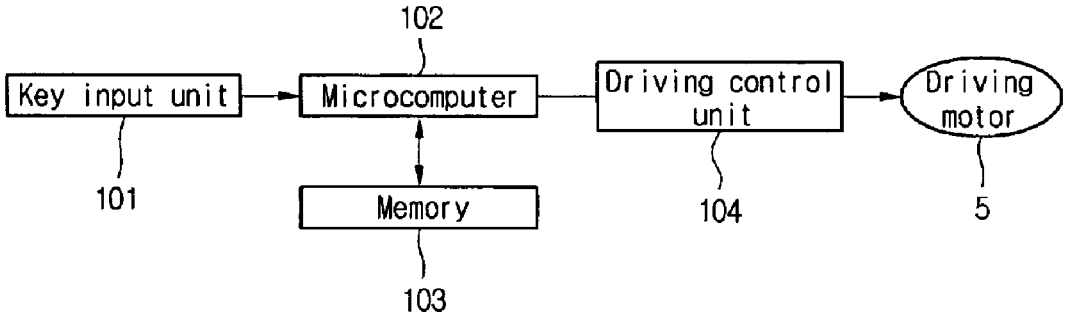

[Fig. 4]
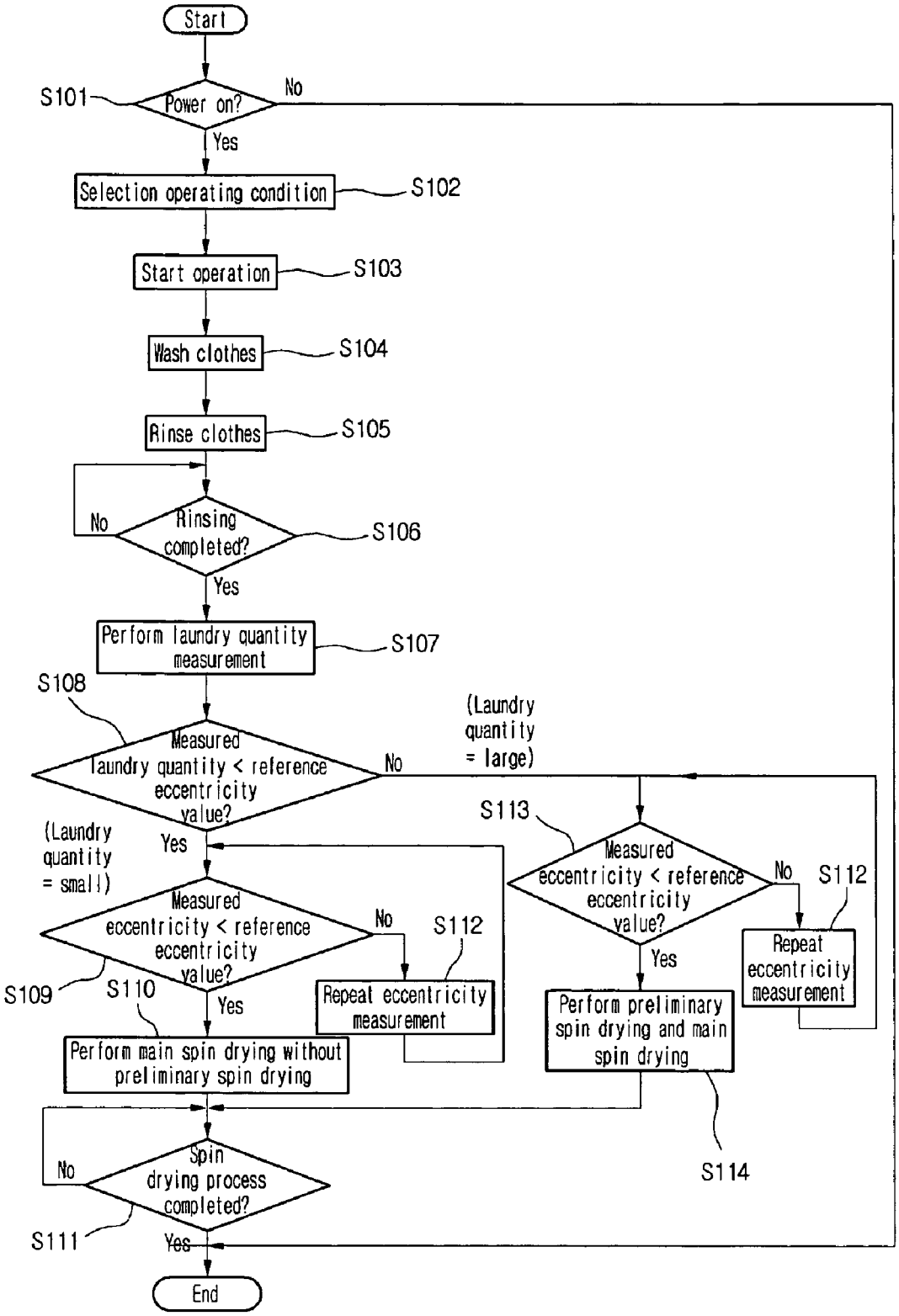

[Fig. 5]
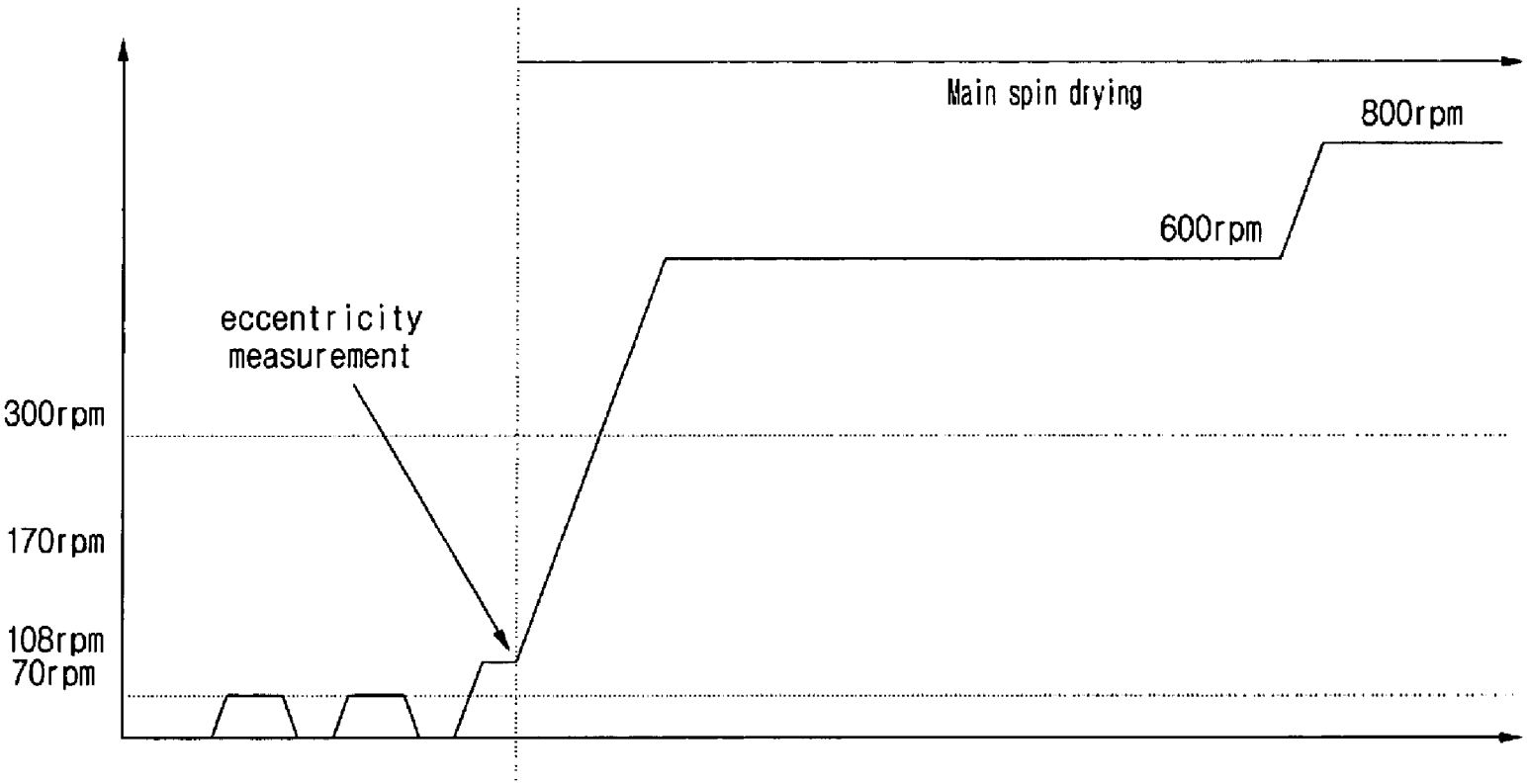

DRUM TYPE WASHING MACHINE AND CONTROLLING METHOD THEREOF

This application claims priority to International Patent Application No. PCT/KR2005/001268 filed on May 2, 2005, as well Korean Application P 2004-0030967 filed on May 03, 2004, both of which are incorporated by reference, as is fully set forth herein.

TECHNICAL FIELD

The present invention relates to a washing machine, and more particularly, to a drum type washing machine and controlling method thereof, in which a preliminary spin drying can be selectively performed according to the eccentricity of a drum and the amount of clothes before a main spin drying is started.

BACKGROUND ART

A washing machine is a home appliance for washing clothes automatically. In a typical washing machine, a motor spins a tub to agitate clothes together with water containing detergent to remove dirt from the clothes. The washing machine can be classified into several types such as a pulsator, an agitator, and a drum types.

The drum type washing machine includes a horizontally mounted drum in which clothes, as the drum is rotated, are lifted and dropped to force water and detergent solution to go through the clothes to remove dirt from the clothes. Since the clothes are lifted and dropped in the drum, the drum type washing machine damages the clothes less than the pulsator type washing machine having a vertically mounted tub. Also, the clothes are cleanly washed without tangling as like it is washed with hands. In addition, the clothes are spin dried with less wrinkles.

Meanwhile, the washing process starts upon the pressing of start button after clothes are loaded in the drum and it ends after the clothes are washed, rinsed, and spin-dried.

FIG. 1 is a motor RPM versus time graph of a spin drying of a drum type washing machine according to the related art.

Referring to FIG. 1, a spin-drying process includes a sequence of operations: an unraveling operation of tangled clothes, first to third balancing operations, first and second preliminary spin dryings, an accelerating operation, and a main spin drying.

In the unraveling operation, the drum is rotated at about 50 rpm for a specific time to disentangle the clothes. In the first to third balancing operations, the drum is rotated at about 108 rpm for a specific time to uniformly arrange the clothes throughout the inside of the drum to balance the drum.

After each of the balancing operations, the eccentricity of the drum may be measured at least one time. That is, the first preliminary spin drying is carried out according to a first eccentricity measurement, the second preliminary spin drying is carried out according to a second eccentricity measurement, and then the main spin drying is carried out according to a third eccentricity measurement.

The preliminary spin dryings may be carried out two or more times to prevent noise and overload on the motor that occur when a large amount of water is removed at once from the clothes at an initial stage of the spin-drying process. In detail the preliminary spin drying operations are carried out as follows: the drum is accelerated to 170 rpm and decelerated to 108 rpm in the first preliminary spin drying; the eccentricity of the drum is measured (second measurement) as the drum is rotated at the speed of 108 rpm; and the drum is accelerated from the speed of 108 rpm to a speed of 300 rpm and decelerated back to the speed of 108 rpm in the second preliminary spin drying. After these preliminary operations, the main spin drying is started by accelerating the drum to 600 rpm and then the drum is further accelerated until the spin drying process is completed.

During the spin-drying process, the drum is rotated by the motor. The motor drives the drum at a lower speed in a washing process and at a high speed in the spin-drying process.

However, the spin-drying process of the related art is carried out according to a fixed procedure regardless of the amount of the loaded clothes in the drum. Therefore, the preliminary spin dryings can be carried out more times and longer than really required, thereby delaying the start of the main spin drying and increasing the power consumption.

DISCLOSURE OF INVENTION

Technical Problem

Accordingly, the present invention is directed to a drum type washing machine and controlling method thereof that substantially obviates one or more of the problems due to limitations and disadvantages of the related art.

An object of the present invention is to provide a drum type washing machine and controlling method thereof, in which a preliminary spin drying operation is selectively carried based on a laundry quantity and an eccentricity of a drum.

Another object of the present invention is to provide a drum type washing machine and controlling method thereof, in which a preliminary spin drying operation is selectively carried out based on a laundry quantity and an eccentricity of a drum to reduce time required to start a main spin drying operation after washing and rinsing operations.

Technical Solution

To achieve these and other advantages and in accordance with the purpose of the present invention, as embodied and broadly described, there is provided a drum type washing machine including: a tub; a drum installed in the tub to rotate about a horizontal axis; a driving motor rotating the drum; a key input unit receiving a washing instruction from a user; a memory storing a reference quantity value and a reference eccentricity value; a microcomputer controlling washing and rinsing operations in accordance with a procedure set by the user upon an input of a start command through the key input unit, the microcomputer controlling a preliminary spin drying operation to be selectively performed based on a comparison result obtained by comparing a measured laundry quantity and a measured eccentricity with the reference quantity value and the reference eccentricity value; and a driving control unit controlling the driving motor in accordance with a control signal of the microcomputer.

According to another aspect of the present invention, there is provided a controlling method of a drum type washing machine, including: performing washing and rinsing operations in accordance with a start command inputted by a user and a procedure selected by the user; performing a laundry quantity measurement operation and an eccentricity measurement operation; and controlling a preliminary spin drying operation to be selectively performed based on the measured laundry quantity and the measured eccentricity.

According to a further another aspect of the present invention, there is provided a controlling method of a drum type washing machine, including: performing washing and rinsing operations according to an inputted condition; proceeding to a spin drying process right after the rinsing operation, and simultaneously performing a laundry quantity measurement operation; performing an eccentricity measurement operation based on the measured laundry quantity; if the measured laundry quantity is smaller than a reference quantity value and the measure eccentricity is smaller than a reference eccentricity value, performing a main spin drying operation without performing a preliminary spin drying operation; and terminating the spin drying process after the main spin drying operation.

Advantageous Effects

According to the present invention, the preliminary spin drying operation can be selectively performed depending on the measured laundry quantity, thereby reducing time required to start the main spin drying operation after the washing and rinsing operations.

Further, the time required to start the main spin drying operation can be adjusted according to the laundry quantity, reducing power consumption.

Furthermore, the reduced time for starting of the main spin drying operation also reduces the entire operational time of the drum type washing machine, thereby increasing user's satisfaction.

BRIEF DESCRIPTION OF THE DRAWINGS

FIG. 1 is a motor rpm versus time graph of a spin drying of a drum type washing machine according to the related art.

FIG. 2 is a cut-away view of a drum type washing machine according to the present invention.

FIG. 3 is a block diagram showing a control structure of a drum type washing machine according to the present invention.

FIG. 4 is a flowchart showing a controlling method of a drum type washing machine according to the present invention.

FIGS. 5 shows a motor rpm versus time graph of a spin drying process of a drum type washing machine according to the present invention.

BEST MODE FOR CARRYING OUT THE INVENTION

Hereinafter, preferred embodiments of the present invention will be described in detail with reference to accompanying drawings.

The terms eccentricity, eccentricity of clothes, and eccentricity of a drum are inter-changeably used here to refer to the degree of static unbalance or dynamic unbalance due to non-uniform arrangement of the clothes inside of the drum of a drum type washing machine.

FIG. 2 is a cut-away view of a drum type washing machine according to the present invention.

Referring to FIG. 2, a drum type washing machine includes an enclosing cabinet 1, a tub 2 supported by a damper 7 and a spring 6 in the cabinet 1, a cylindrical drum 3 installed in the tub 2 to rotate about a horizontal axis, and a driving motor 5 connected to the drum 3.

The driving motor 5 is connected to a back of the tub 2 and it includes a rotor 52 and a stator 51. The rotor 52 is connected to a drum shaft 4 without using a pulley and a belt for a direct power transmission to the drum 3.

Also, the drum type washing machine includes a door 8 on a front of the cabinet 1 to cover an opened front of the drum 3, a gasket 9 between the door 8 and the drum 3 to make the joint fluid-tight, and a control panel 10 above the door 8 to receive instructions from a user and control the overall operation of the drum type washing machine.

An operation of the drum type washing machine will now be described according to the present invention.

When a user select operating conditions using the control panel 10 and presses a start button, water flows into the drum 3 until the drum 3 is filled to a certain level, and the driving motor 5 is operated. By the operation of the driving motor 5, the rotational torque of the rotor 52 is transmitted to the drum shaft 4 to rotate the drum 3, and clothes in the drum 3 is lifted up by a lifer 31 and dropped down by gravity during the rotation of the drum 3. In this way a washing operation is carried out.

The up and down motions of the clothes in the drum 3 forces the water to frictionally pass through the clothes to remove dirt from the clothes. The clothes are cleaned by repetition of these motions.

In a spin drying operation after the washing operation, the drum 3 is rotated at a high speed to remove water from the clothes by a centrifugal force. A discharge pump is driven to discharge the water spun out from the clothes through a discharge line.

FIG. 3 is a block diagram showing a control structure of a drum type washing machine according to the present invention.

Referring to FIG. 3, the drum type washing machine includes a key input unit 101, a microcomputer 102, a driving control unit 104, the driving motor 5, and a memory 103. With the key input unit 101, a user inputs operating conditions. The microcomputer 102 outputs control signals according to the operating conditions from the key input unit 101, and when the spin drying operation is started, the microcomputer 102 controls an eccentricity measurement and a laundry quantity measurement to prevent a preliminary spin drying operation is uselessly repeated. The driving control unit 104 controls the driving motor 5 according to the control signals of the microcomputer 102, and the memory 103 stores a reference eccentricity value and a reference quantity value for comparison with the measured eccentricity and the measured laundry quantity.

In operation, a user turns on the drum type washing machine and inputs desired operating conditions through the key input unit 101.

When the user inputs a start instruction through the key input unit 101, the microcomputer 102 controls the operation of the drum type washing machine according to the operating conditions inputted by the user and controls the washing machine to perform an eccentricity measurement and a laundry quantity measurement after washing and rinsing operations but before a spin drying operation. If the measured laundry quantity is smaller than the reference quantity value, a main spin drying operation is performed according to the measured eccentricity without performing a preliminary spin drying operation. If the measured laundry quantity is not smaller than the reference quantity value, the main spin drying operation is performed according to the measured eccentricity after the preliminary spin drying operation is carried out.

FIG. 4 is a flowchart showing a controlling method of a drum type washing machine according to the present invention, and FIG. 5 shows a motor rpm versus time graph of a spin drying process of a drum type washing machine according to the present invention.

Referring to FIGS. 4 and 5, in operations S101 and S102, a user inputs a power-on instruction and selects desired operating conditions. In operations S103 to S105, clothes are washed and rinsed upon the press of start button and in accordance with the selected operating conditions.

In operation S106, it is determined whether the rinsing operation S105 is completed, and, if so, the driving motor 5 is stopped.

In operation S107, a laundry quantity measurement operation is carried out to measure the amount of clothes in the drum 3. In operation S108, it is determined whether the measured laundry quantity is smaller than the reference quantity value. If so, the process goes to operation S109, and, if not, the process goes to operation S113. Here, the term "laundry quantity" is used to refer to the volume of the laundry or the weight of the laundry after the rinsing operation.

In operation S109, an eccentricity measurement operation is carried out. In detail, the drum 3 is accelerated from a stationary state to a specific speed where the eccentricity of the drum 3 to be measured and it is kept at the specific speed for a predetermined time. The specific speed may be about 108 rpm. This acceleration of the drum 3 uniformly arranges the laundry throughout the inner side of the drum 3, and the drum 3 is kept at the specific speed for a predetermined time for a balancing operation. During this balancing operation, the eccentricity measurement operation is carried out to determine whether the measured eccentricity is smaller than the reference eccentricity value. If so, the process goes to operation S110 and, if not, the process goes to operation S112. In operation S112, the drum 3 is decelerated to a stationary state and accelerated again to the specific speed to repeat the eccentricity measurement operation. These deceleration and acceleration motions (balancing operation) are repeated until the eccentricity of the drum 3 becomes smaller than the reference eccentricity value. In operation S110, a main spin drying operation is carried out without performing a preliminary spin drying operation. After the main spin drying operation, the entire spin drying process is completed.

Meanwhile, in operation S113, an eccentricity measurement operation is carried out to determine whether the measured eccentricity is smaller than the reference eccentricity value. If so, the process goes to operation S114, and, if not, the process goes to operation S115.

In operation S115, the eccentricity measurement operation is repeated in such a way of repeating balancing and measurement operations until the eccentricity becomes smaller than the reference eccentricity value. If the eccentricity becomes smaller than the reference eccentricity value, a preliminary spin drying operation and a main spin drying operation are carried out in operation S114. Here, the preliminary spin drying operation may be carried out one or more times under the control of the microcomputer 102 according to the laundry quantity. In operation S111, it is determined whether the entire spin drying process is completed. Upon the completion of the spin drying process, the rotation of the drum 3 is stopped.

Referring again to FIG. 5, before the spin drying process, the laundry quantity is measured to determine whether the laundry quantity is smaller than the reference quantity value. If so, the main spin drying operation is carried out without performing the preliminary spin drying operation after the eccentricity measurement operation is carried out one or more times according to the measured eccentricity. If not, at least one preliminary spin drying operation is carried out before the main spin drying operation after the eccentricity measurement operation is carried out one or more times according to the measured eccentricity.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

According to the present invention, the preliminary spin drying operation is selectively carried out depending on the laundry quantity, such that the time required to start the main spin drying operation after the washing and rinsing operations can be reduced, and the drum type washing machine can be operated with less power consumption. Therefore, the present invention can be applied to various fields.

The invention claimed is:

1. A controlling method of a drum type washing machine, comprising:

performing washing and rinsing operations in accordance with a start command inputted by a user and a procedure selected by the user;

performing a laundry quantity measurement operation after end of the washing and rinsing operations;

selectively performing a preliminary spin drying operation only when the measured laundry quantity is the same as or bigger than a reference quantity value;

performing a main spin drying operation; and terminating the spin drying process after the main spin drying operation.

2. The controlling method according to claim 1, wherein the laundry quantity is the volume of laundry loaded in a drum and/or the weight of the laundry after the rinsing operation.

3. The controlling method according to claim 1, further comprising:

performing an eccentricity measurement operation after the laundry quantity measurement operation;

performing a determining operation to determine whether the measured eccentricity is smaller than a reference eccentricity value, wherein the eccentricity measurement operation and the determining operation are repeated until the measured eccentricity becomes smaller than the reference eccentricity value.

4. The controlling method according to claim 3, wherein the eccentricity measurement operation includes stopping a drum and accelerating the drum again.

5. The controlling method according to claim 3, wherein the preliminary spin drying operation is performed when the measured eccentricity is smaller than the reference eccentricity value.

6. The controlling method according to claim 3, wherein the preliminary spin drying operation is carried out at least one time and the main spin drying operation is carried out after the preliminary spin drying operation.

7. The controlling method according to claim 1, wherein the preliminary spin drying operation is carried out one or more times under an automatic control of a microcomputer based on the measured laundry quantity.

* * * * *